US006388579B1

(12) United States Patent
Adcox et al.

(10) Patent No.: US 6,388,579 B1
(45) **Date of Patent: *May 14, 2002**

(54) APPARATUS AND SYSTEM FOR REMOTELY UPDATING AND MONITORING THE STATUS OF A VEHICLE

(75) Inventors: Thomas A. Adcox, Nevada, TX (US); William R. Adcox, Lexington, OK (US)

(73) Assignee: Intelligent Vehicle Systems, Inc., Rowlett, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/469,560

(22) Filed: Dec. 22, 1999

Related U.S. Application Data

(60) Provisional application No. 60/147,974, filed on Aug. 9, 1999.

(51) Int. Cl.[7] ..... G08G 1/00

(52) U.S. Cl. ..... 340/902; 340/425.5; 340/426; 340/928; 340/905; 340/539; 340/7.21; 340/10.1; 340/10.6; 340/825.69; 340/825.72; 340/286.01; 701/35

(58) Field of Search ..... 340/425.5, 426, 340/928, 902, 901, 904, 905, 988, 989, 990, 991, 992, 993, 994, 995, 996, 539, 540, 531, 534, 572.1, 825.33, 825.3, 825.34, 825.36, 825.44, 825.49, 10.1, 10.4, 10.41, 10.42, 10.6, 825.69, 825.7, 286.01

(56) References Cited

U.S. PATENT DOCUMENTS

| | | | |
|---|---|---|---|
| 5,113,427 A | 5/1992 | Ryoichi et al. | 379/57 |
| 5,500,638 A | 3/1996 | George | 340/468 |
| 5,629,693 A | 5/1997 | Janky | 340/988 |
| 5,631,631 A | 5/1997 | Deschenes | 340/572 |

(List continued on next page.)

FOREIGN PATENT DOCUMENTS

| | | |
|---|---|---|
| WO | WO98/43104 | 10/1998 |
| WO | WO99/22353 | 5/1999 |

OTHER PUBLICATIONS

"RF Tagging: the Future for Tracking?", Apr. 1999, pp. 1–2.
"Radios, Tracking Devices and Boat Accessories", Feb. 1999, pp. 1–4.
"Trackmaster Arrow Tracking Systems", Aug. 1998, pp. 1–6.
"The Care Trak Home System", 1997, pp. 1–3.
US Spectrum Requirements: Projections and Trends–Chapter 4, "Radiodetermination and Radiodetermination–Satellite Services", pp. 1–29.

*Primary Examiner*—Nina Tong
(74) *Attorney, Agent, or Firm*—Smith, Danamraj & Youst, P.C.

(57) ABSTRACT

A vehicle status device and system for remotely updating and monitoring the status of a vehicle. The vehicle status device is located in a vehicle and reports status information for the vehicle and an owner to an interrogating unit. The device includes a database of status information for the vehicle and owner. An update receiver in the device receives updated information from a wide area paging network for storage in the database. An interrogation receiver receives an interrogation signal from the interrogating unit, and a response transmitter transmits encoded status information, including a vehicle identification (VID), to the interrogating unit in response. The updating and monitoring system also includes an interrogating unit which includes an interrogation transmitter for transmitting the interrogation signal to the vehicle status device, and a response receiver for receiving the encoded status information from the vehicle status device. A processor decodes the encoded status information and translates it into plain language for presentation to an operator. The system may be implemented as a ticket-less toll system by providing a database of subscribers in which VIDs are matched to subscriber identities, credit card information, and current status as valid subscribers.

4 Claims, 4 Drawing Sheets

U.S. PATENT DOCUMENTS 5,787,174 A 7/1998 Tuttle ..... 380/23
5,798,714 A 8/1998 Nyfelt ..... 340/988
5,831,519 A 11/1998 Pedersen et al. ..... 340/425.5
5,847,661 A * 12/1998 Ricci ..... 340/902
5,891,043 A 4/1999 Ericksen et al. ..... 600/508
5,917,405 A 6/1999 Joao ..... 340/426
5,926,086 A 7/1999 Escareno et al. ..... 340/426
5,929,752 A 7/1999 Janky et al. ..... 340/426
5,963,129 A * 10/1999 Warner ..... 340/468
6,028,537 A * 2/2000 Suman et al. ..... 340/988
6,052,068 A * 4/2000 Price et al. ..... 340/933
6,163,277 A * 12/2000 Gehlot ..... 340/905
6,167,333 A * 12/2000 Gehlot ..... 701/35
6,222,463 B1 * 4/2001 Rai ..... 340/928

* cited by examiner

APPARATUS AND SYSTEM FOR REMOTELY UPDATING AND MONITORING THE STATUS OF A VEHICLE

PRIORITY STATEMENT UNDER 35 U.S.C. § 119(e) & 37 C.F.R. § 1.78

This nonprovisional application claims priority based upon the prior U.S. provisional patent application entitled, "Intelligent Vehicle", application Ser. No. 60/147,974, filed Aug. 9, 1999, in the names of Thomas A. Adcox and William R. Adcox.

BACKGROUND OF THE INVENTION

1. Technical Field of the Invention

This invention relates generally to vehicle identification and location devices and, more particularly, to an apparatus and system for remotely updating and monitoring the status of a vehicle.

2. Description of Related Art

There are millions of cars and trucks operating on the road today. Local, state, and national governments attempt to control the licensing and operation of these vehicles in order to promote public safety and obtain revenue. In addition to the well known requirements for obtaining a driver's license, state governments typically require that an annual registration fee be paid for each vehicle in order to maintain a current license for the vehicle. In addition, most states require that a safety inspection be performed on the vehicle each year by a state-approved inspection station.

In recent years, many states have passed laws requiring that drivers maintain a minimum level of liability insurance for each vehicle that they operate. In an effort to enforce these laws, drivers may be required to present proof of insurance for their vehicle at the time that they obtain a safety inspection or renew their registration. However, there are still major problems in many states with uninsured drivers. These drivers may forge proof-of-insurance papers when they obtain a safety inspection or renew their registration, or they may purchase insurance when an inspection or registration is due, and then cancel it after the inspection or registration is complete. These actions increase the cost of insurance for all of the legitimate vehicle operators in the state.

Law enforcement personnel have an additional problem in identifying stolen vehicles. Some vehicles may be equipped with security systems which broadcast a location for the vehicle if the vehicle is started and/or driven without performing certain security functions. These security systems can assist the police in locating the stolen vehicle. Most vehicles, however, do not have such security systems, and even for ones that do, actual identification of the vehicle is still difficult. The police must visually read the license number and verify this number in their database.

In order to overcome the disadvantage of existing solutions, it would be advantageous to have an apparatus and system for remotely updating and monitoring the status of a vehicle. Such an apparatus and system could be utilized by law enforcement personnel to quickly and easily determine the status of any vehicle and its operator. The present invention provides such an apparatus and system.

SUMMARY OF THE INVENTION

In one aspect, the present invention is a vehicle status device for reporting status information for a vehicle to an interrogating unit. The device includes a database of status information for the vehicle, an update receiver that receives updated vehicle information for storage in the database, an interrogation receiver that receives an interrogation signal from the interrogating unit, and a response transmitter for transmitting the vehicle status information to the interrogating unit in response to the interrogation receiver receiving the interrogation signal.

In another aspect, the present invention is a vehicle status device for reporting status information for a vehicle and an owner of the vehicle to an interrogating unit. The device includes a database of status information for the vehicle and the owner, a wide area pager receiver that receives encoded updated vehicle and owner information from a wide area paging network, an interrogation receiver that receives an interrogation signal from the interrogating unit, and a response transmitter for transmitting encoded vehicle and owner information to the interrogating unit. The device also includes a processor having a coder/decoder that decodes the updated information received from the wide area paging network and sends the decoded information to the database. In response to the interrogation receiver receiving the interrogation signal, the processor retrieves the information from the database, encodes the information, and sends it to the response transmitter.

In yet another aspect, the present invention is a system for remotely updating and monitoring the status of a vehicle. The system includes a vehicle status device for reporting status information for the vehicle to an interrogating unit. The vehicle status device includes a database of status information for the vehicle, an update receiver that receives updated vehicle information for storage in the database, an interrogation receiver that receives an interrogation signal from the interrogating unit, and a response transmitter for transmitting the vehicle status information to the interrogating unit in response to the interrogation receiver receiving the interrogation signal. The updating and monitoring system also includes an interrogating unit comprising an interrogation transmitter for transmitting the interrogation signal to the vehicle status device, and a response receiver for receiving the vehicle status information from the vehicle status device. The interrogation signal may be a radar or laser signal from a standard police radar/laser speed detector. The response transmitter may transmit a radio frequency (RF) signal in response which is received by an RF response receiver in the interrogating unit.

In yet another aspect, the present invention is a ticket-less toll system that includes a vehicle reporting device located in a vehicle for reporting the vehicle identification (VID), an interrogating unit, and a subscriber database. The interrogating unit may be located in a toll booth, and as the vehicle approaches the toll booth, an interrogation transmitter transmits an interrogation signal to the vehicle reporting device. As before, the interrogation signal may be a radar or laser signal from a standard police radar/laser speed detector. An interrogation receiver in the vehicle reporting device receives the interrogation signal, and a RF response transmitter transmits the VID to an RF response receiver in the interrogating unit in response. A processor in the interrogating unit queries a database of subscribers for subscriber information associated with the VID. The database matches the VID with a subscriber, and provides associated credit card information and an indication of whether the subscriber is currently a valid subscriber.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The present invention is essentially a remotely updatable vehicle transponder and system. Vehicle and operator status information is downloaded to the vehicle through a wide area paging network. When a police unit directs a radar/laser gun toward the vehicle, the system responds by transmitting encoded status information back to the police unit. The vehicle status information is decoded by the police unit and displayed in plain language for the police officer to easily discern the status of the vehicle and the operator.

Figure 1:
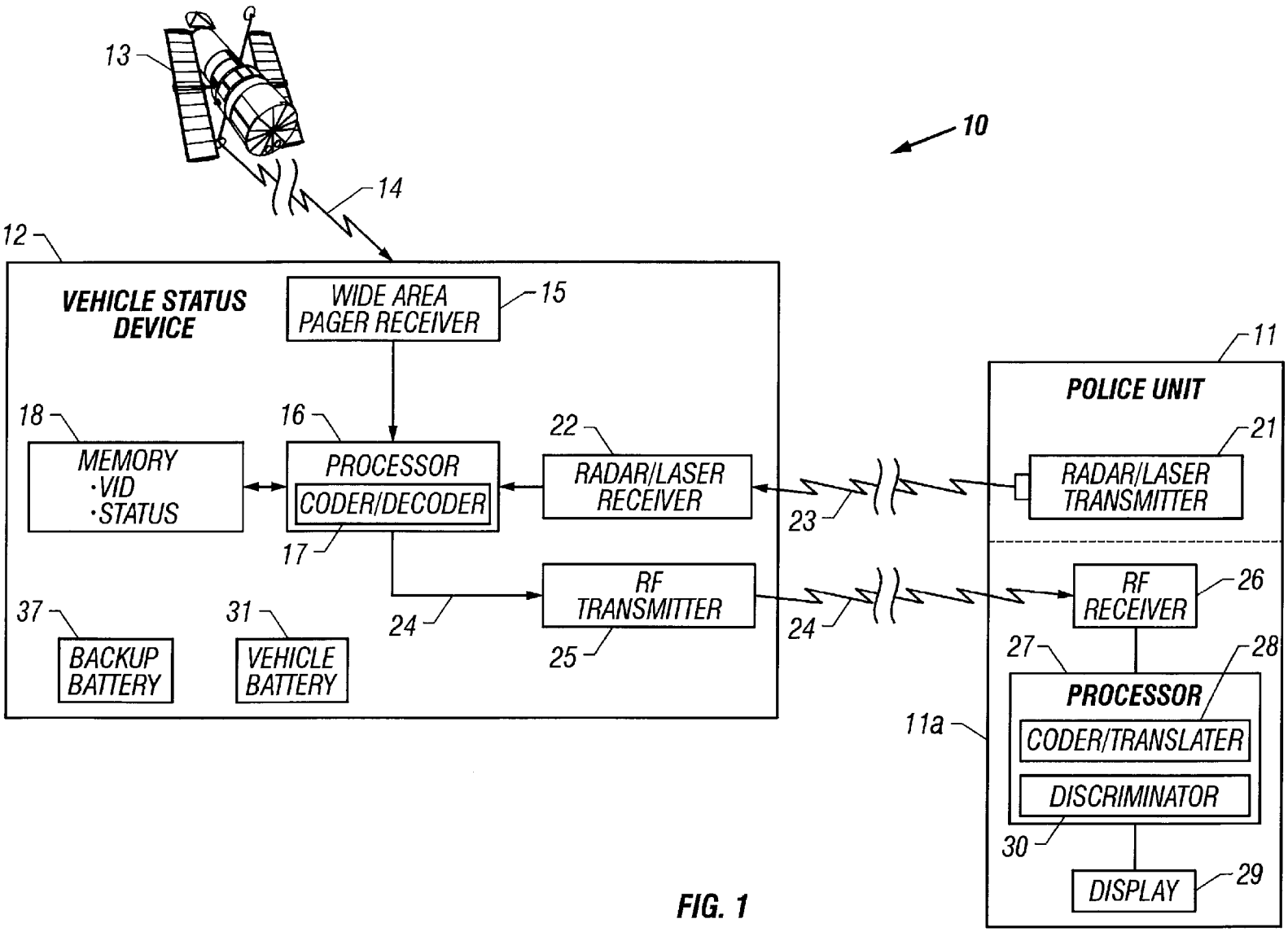
FIG. 1 is a simplified block diagram of a vehicle status device and police unit in the preferred embodiment of the system of the present invention.

FIG. 1 is a simplified block diagram of the preferred embodiment of the system of the present invention. The system 10 includes a police unit 11 and a vehicle status device 12. The system may also include a wide area paging network 13 which may be a satellite-based network or a ground-based network such as a cellular network. Updates to the status of the vehicle and/or the operator are communicated from state and local agencies, insurance companies, inspection stations, and/or law enforcement agencies to the wide area paging network. For example, the updates may include, but are not limited to:

A renewed or expired registration;

A passed, failed, or out of date safety inspection;

Inadequate or no liability insurance;

The identity of the registered owner;

Whether there are any warrants for the owner;

Expiration, revocation, or modification of the owner's driver's license, including any newly added restrictions;

Owner status that is required by law to be reported to local authorities such as convicted sex offender status or convicted felon; and Whether the vehicle has been reported as stolen.

The paging network encodes the updated status information and uses the VID of the vehicle to transmit a paging signal with the encoded status information 14 to the vehicle. The information is received in a wide area pager receiver 15. The wide area pager receiver may be a standard wide area pager receiver which passes the encoded status information to a processor 16. The system may optionally be equipped with a page response device (not shown) which transmits a page response to the wide area paging network to confirm that the updated status information was received. The processor includes a coder/decoder 17 which extracts the updated status information from the paging signal. The status information is then stored in a memory device 18 along with the vehicle identification (VID).

The police unit 11 includes a radar/laser transmitter 21 which may be a standard police radar or laser gun normally utilized to determine the speed of a vehicle. The transmitter may operate in standard police bands such as X, K, Ka as well as laser frequencies such as a 904 nanometer laser. When the radar/laser transmitter is directed toward the vehicle status device 12, a radar/laser receiver 22 in the vehicle detects the transmitted signal 23 which acts as an interrogation trigger. The receiver 22 notifies the processor 16 that a trigger has been received. In response, the processor pulls the current status information from memory 18 and uses the coder/decoder 17 to encode the information. The encoded current status information 24 is sent to a radio frequency (RF) transmitter 25 in the vehicle from which it is transmitted back to the police unit. The vehicle status device 12 may require external antennas (not shown) for the radar/laser receiver 22 and the RF transmitter 25 if the device is mounted under the vehicle hood or in some other location where the device is shielded. Omni-directional antennas may be utilized since the direction of the police unit is not known.

The encoded current status information is received by an RF receiver 26 in the police unit. The signal is then sent to a processor 27 where a decoder/translator 28 decodes the status information and uses, for example, a look-up table to provide a plain-language translation of the decoded current status information. The plain-language translation of the current status information is then displayed on a display screen 29 for the police officer to view.

It is possible for several vehicles in close proximity to detect the interrogation trigger from the police unit and transmit a response. Therefore, the processor may also include a discriminator 30 that discriminates between multiple responses and prioritizes the responses. The discriminator may, for example, prioritize the responses so that the most serious infractions or dangerous situations are displayed first to the police officer. For example, a vehicle response indicating that the vehicle has been stolen may be displayed before the response of another vehicle indicating that the safety inspection is overdue.

Although the police unit 11 is depicted in FIG. 1 as a single unit, in practice the components of the police unit may comprise a police radar/laser gun 21 which is separate from a receiving and display unit 11*a*. This potential separation is indicated by the dashed line in FIG. 1. The radar/laser gun may be located in the same police car as the receiving and display unit, or it may be remotely located since no direct connection is required between the radar/laser gun and the receiving and display unit.

In the preferred embodiment, the vehicle status device 12 is powered from the vehicle battery 31. The vehicle status device may be mounted in any suitable container, and may be mounted in any suitable location in the vehicle. For example, the device may be mounted under the hood in an auto-accessory package similar to a fuse box. Alternatively, as shown in the side elevational view of FIG. 2, the vehicle status device may be contained in a cylindrical casing 32 which mounts onto a battery cable 33 from the vehicle battery. The battery cable includes an insulation layer 34 and a conductor 35. Power may be introduced by piercing the battery cable insulation or connecting to the cable connector, and connecting the casing to an external ground 36. In another embodiment, both ends of the casing are sealed to the battery cable in such a manner that any attempt to remove the device results in disabling the vehicle. Antennas and laser targets may be mounted externally in other locations on the vehicle while the electronics are mounted under the hood.

An internal rechargeable backup battery 37 (FIG. 1) is utilized in the vehicle status device 12 to ensure that data is not lost if and while the car battery is disconnected. The backup battery senses power removal and notifies the processor 16. The processor may set the system to a standby mode to conserve battery power, and/or may set a special code to indicate in future interrogation responses that power was lost at some point.

Figure 2:
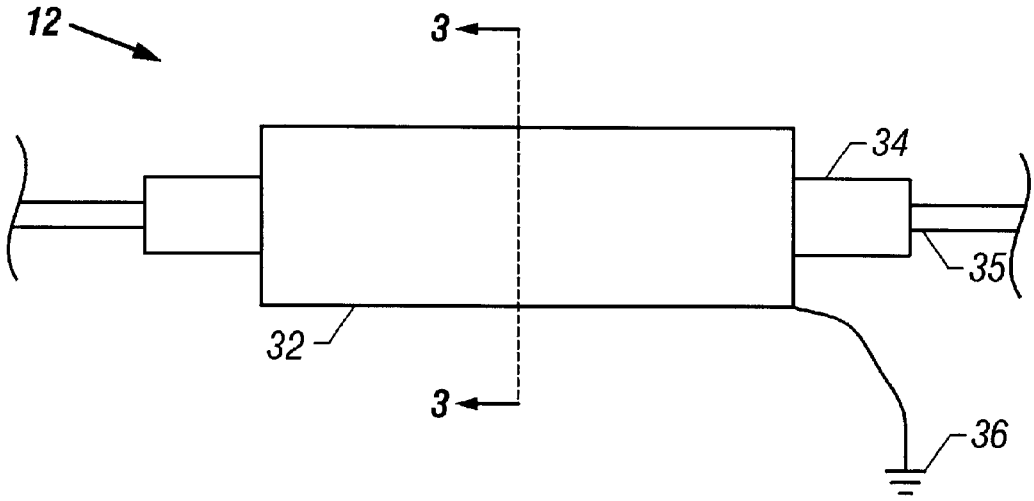
FIG. 2 is a side elevational view of the vehicle status device mounted on a vehicle battery cable.
Figure 3:
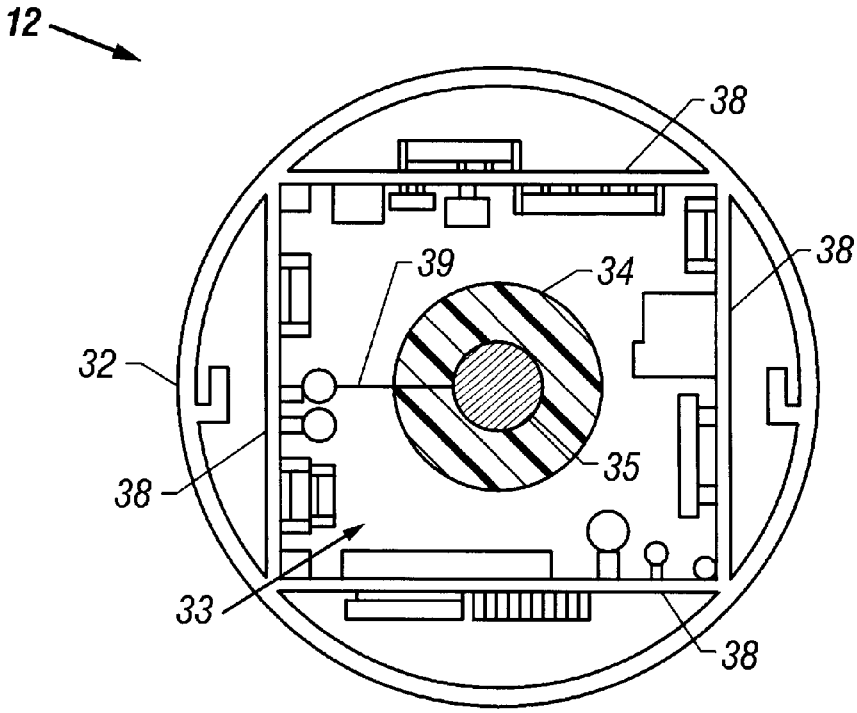
FIG. 3 is a cross sectional view of the vehicle status device taken along line 3—3 of FIG. 2.

FIG. 3 is a cross sectional view of the vehicle status device 12 taken along line 3—3 of FIG. 2. The cylindrical casing 32 surrounds the battery cable 33 from the vehicle battery. A plurality of circuit boards 38 are mounted within the casing and surrounding the battery cable. An electrode 39 pierces the insulation layer 34 of the battery cable and makes contact with the conductor 35.

Figure 4:
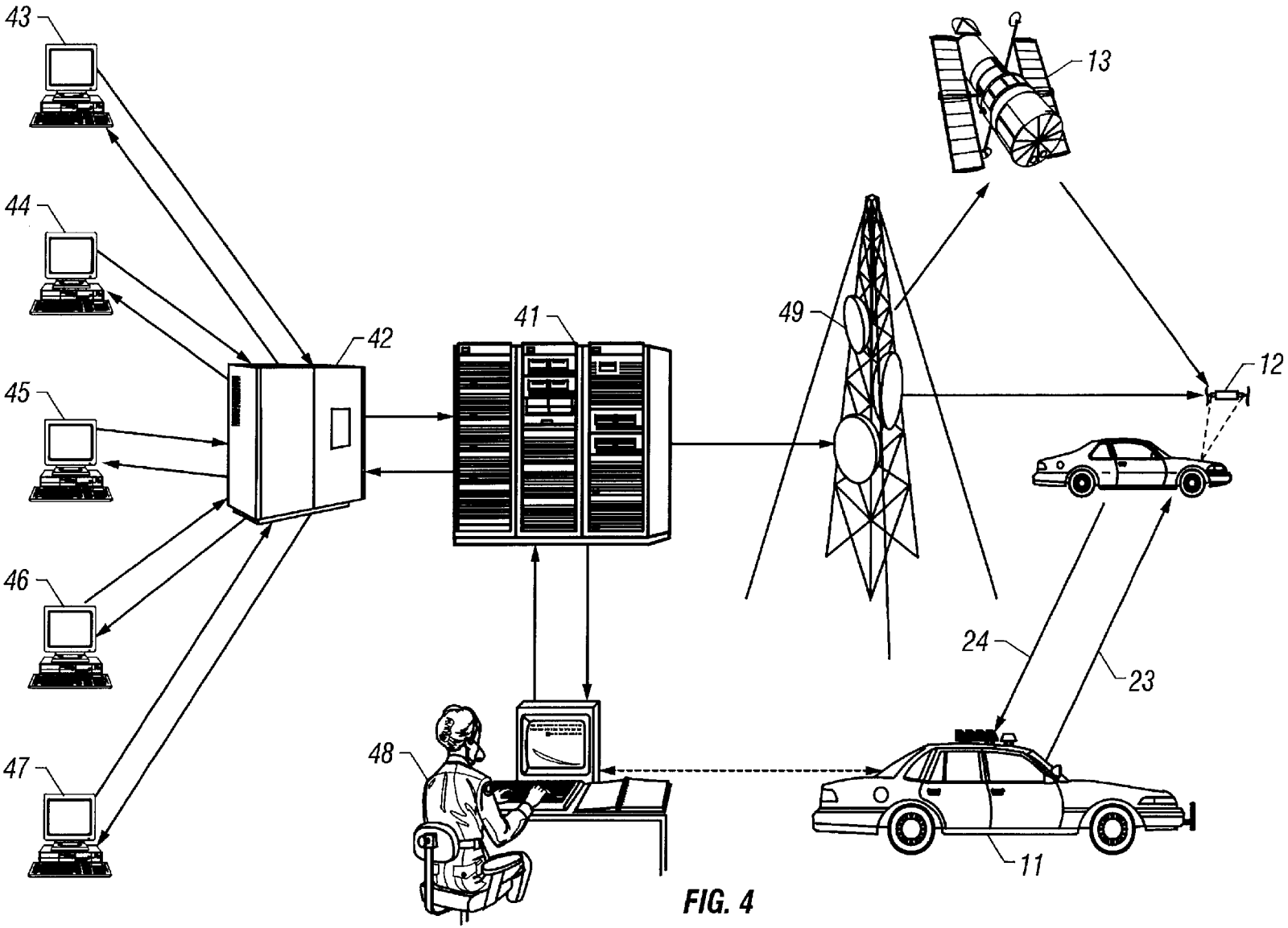
FIG. 4 is a functional block diagram of the system of the present invention in which a data network monitors, processes, and updates vehicle status.

FIG. 4 is a functional block diagram of a data network in which vehicle status is monitored, processed, and updated in accordance with the teachings of the present invention. The network is controlled by a network processor 41 which maintains a central database 42 comprising vehicle status records. The database is populated with vehicle status information and owner information obtained from a plurality of sources. Insurance offices 43 provide information regarding the current status of any automobile insurance policies covering each vehicle in the database. Tax offices 44 provide information regarding the payment of vehicle registration fees and property taxes. Inspection stations 45 provide information regarding state safety inspections on each vehicle in the database. Police departments 46 provide information regarding whether or not the vehicle is stolen, and information about the owner such as any outstanding warrants, felony convictions, etc. Government offices 47 provide information regarding the ownership of the vehicle and other information. Additionally, in one embodiment of the present invention, police departments may help provide emergency messaging services. When someone needs to get an emergency message to a driver, they contact the police department which then updates the database with an indication that the driver has an emergency message. The vehicle status device 12 is then updated, and whenever any police officer radars the driver's vehicle, the police unit receives an indication that the driver has an emergency message. The police can then inform the driver, for example, to phone home.

The various information sources may automatically send data to the central database 42 whenever the data changes, they may periodically update the database, or the central database may periodically query the various information sources in order to keep the data current. Likewise, a system operator 48 may direct that certain data be updated. This may occur, for example, when a police officer obtains a questionable response from a vehicle and asks the system operator for clarification.

Under the control of the network processor 41, data from the central database is sent to a transmitting facility 49 which is part of a wide area paging network. As noted in the description of FIG. 1, the wide area paging network may be a satellite-based network or a ground-based network such as a cellular network. Using the unique ID of each vehicle, the data is transmitted to each vehicle status device 12. Thereafter, when the vehicle status device detects a radar or laser interrogation 23, a response 24 including the status information is transmitted by the vehicle status device's RF transmitter. This information is then decoded and displayed for the police officer.

In addition to the basic function of providing the police with information regarding vehicle registrations, safety inspections, automobile insurance, auto theft, warrants for the owner, and drivers license restrictions for the owner, the present invention may be utilized to perform other useful functions. Emergency messaging has already been described. Additionally, the vehicle status device 12 may provide the response necessary for access to a gated community or other restricted area. Also, businesses in high crime areas, or businesses that are particularly susceptible to crimes in which a vehicle may be involved (such as banks or convenience stores, etc.), may utilize an embodiment of the present invention in which all vehicles visiting the business are routinely interrogated for status information. This information is then recorded, and if a crime is committed, the status information becomes valuable information in the crime investigation.

Additionally, the vehicle status devices in vehicles that carry hazardous materials can be updated with information related to whether a vehicle is currently carrying hazardous material and the nature of the material being carried.

Figure 5:
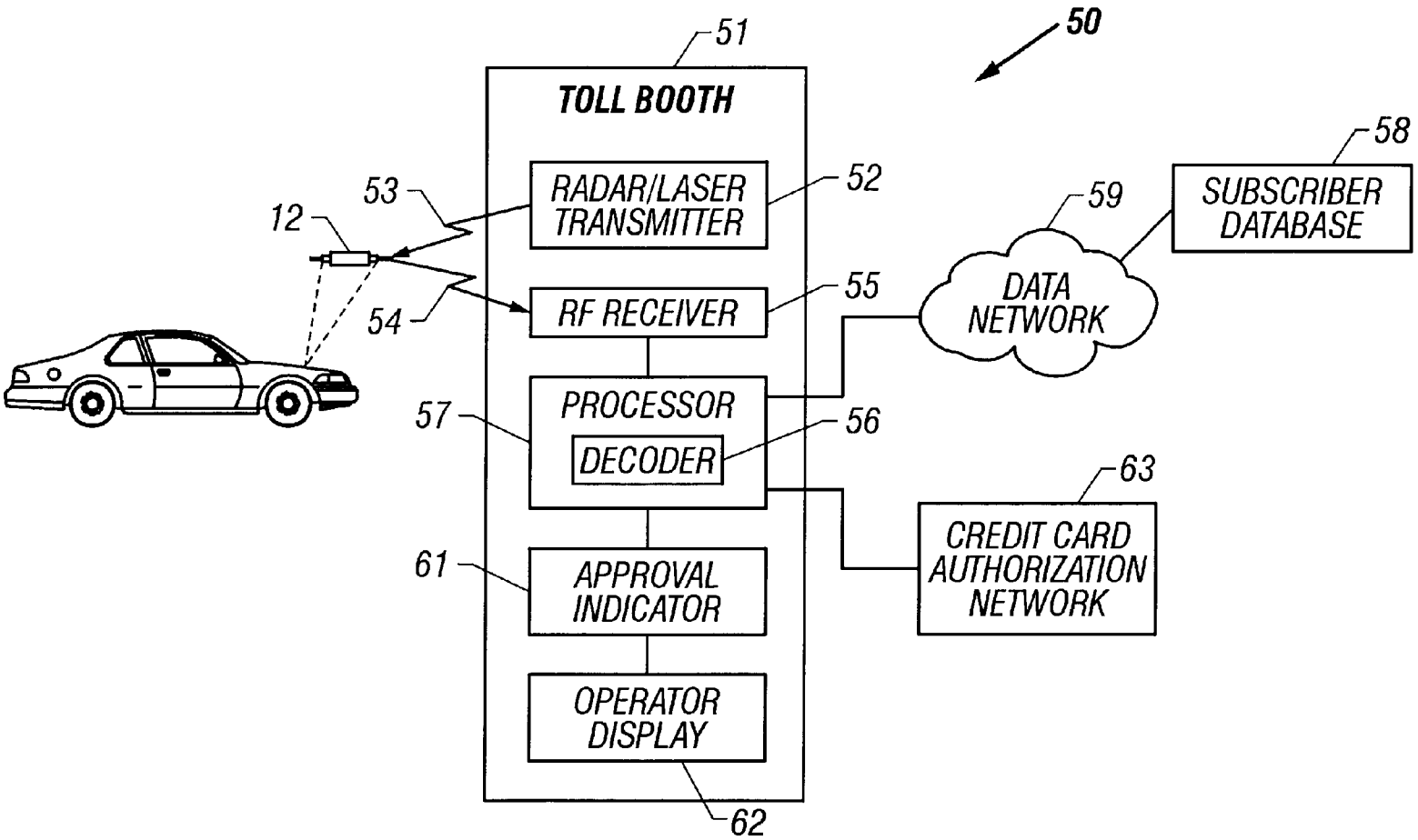
FIG. 5 is a simplified block diagram of a nationwide ticket-less toll system utilizing the vehicle status device and system of the present invention.

The present invention may also be utilized to implement a nationwide ticket-less toll system 50, as illustrated in FIG. 5. Participating vehicle owners can subscribe to the ticket-less toll system by providing confidential credit card information and agreeing to pay all toll charges accrued in the system. The toll system operator may conduct preliminary credit checks at this time. All toll booths such as toll booth 51 are then equipped with a radar/laser transmitter 52 which sends an interrogation signal 53 to each approaching vehicle. The interrogation signal triggers an RF response 54 from the vehicle status device 12 in each approaching vehicle. The RF response contains an identification tag which may be, for example the VID for the vehicle, which can then be matched to an identity of the owner.

The RF response is received by an RF receiver 55 in the toll booth, and is decoded by decoder 56 in a processor 57. The processor compares the VID from the response to a database of subscribers 58. The subscriber database may be located locally at the toll booth or may be remotely located and accessed over a data network 59. The database matches the VID with the subscriber's name, address, credit card information, and an indication of whether the subscriber is currently a valid subscriber. If the VID is for a valid subscriber, the toll booth approves the passage of the vehicle and an indicator 61 (such as a green light) provides the driver with approval to pass through the toll booth without having to stop. An operator display 62 may also provide the toll booth operator with an indication that the vehicle is approved for passage. The ticket-less toll system then charges the owner's credit card for the toll. Credit card transactions may be conducted in non-real time through a credit card authorization network 63. Vehicles that do not respond to the radar/laser interrogation must stop and manually pay the toll.

Since many toll plazas have more than one toll booth, there is a requirement to identify which lane the approaching vehicle is in so that the indication to proceed is provided to the correct vehicle. Adjustments may be made to the sensitivity of the radar/laser receiver 22 and/or to the transmitter power or antenna gain of the radar/laser transmitter 52 so that a response is not triggered from the approaching vehicle until the vehicle is in a particular lane and in close proximity to the toll booth.

The present invention may also be utilized by new car dealers for inventory control. With a laser/radar transmitter and an RF receiver unit similar to the police unit 11 of FIG. 1, the dealer can quickly survey all of the cars on his lot for VIDs and other status information that may be factory programmed into the vehicle status devices 12.

It is thus believed that the operation and construction of the present invention will be apparent from the foregoing description. While the apparatus and system shown and described has been characterized as being preferred, it will be readily apparent that various changes and modifications could be made therein without departing from the scope of the invention as defined in the following claims.

What is claimed is:

1. A vehicle status device mounted in a vehicle for reporting status information for the vehicle to an external interrogating unit, said status device comprising:

a control processor;

a device memory interfaced with the processor that stores status information for the vehicle;

an update receiver that receives updated vehicle status information from an external central database and passes the information to the processor for storage in the device memory;

a radar receiver that receives a dataless radar signal from an external policeradar transmitter, and passes an indication of receiving the radar signal to the processor for retrieval of the status information from the device memory; and a response transmitter that transmits the retrieved vehicle status information to the external interrogating unit in response to the radar receiver receiving the dataless radar signal.

2. A vehicle status device mounted in a vehicle for reporting status information for the vehicle to an external interrogating unit, said status device comprising:

a control processor;

a device memory interfaced with the processor that stores status information for the vehicle;

an update receiver that receives updated vehicle status information from an external central database and passes the information to the processor for storage in the device memory;

a laser detector that detects a dataless laser signal from an external police laser transmitter, and passes an indication of receiving the laser signal to the processor for retrieval of the status information from the device memory; and a response transmitter that transmits the retrieved vehicle status information to the external interrogating unit in response to the laser detector receiving the dataless laser signal.

3. A vehicle status device mounted in a vehicle for reporting status information for the vehicle and an owner of the vehicle to an external interrogating unit, said status device comprising:

a control processor;

a device memory interfaced with the processor that stores status information for the vehicle and the owner;

a wide area pager receiver that receives encoded updated vehicle and owner information from an external central database through a wide area paging network, and passes the updated information to the processor for storage in the device memory;

a radar receiver that receives a dataless radar signal from an external police radar transmitter, and passes an indication of receiving the radar signal to the processor for retrieval of the status information from the device memory;

a response transmitter that receives retrieved encoded vehicle and owner information from the processor, and transmits the retrieved encoded vehicle and owner information to the external interrogating unit; and a coder/decoder that decodes the updated information received from the wide area paging network and encodes the information retrieved from the device memory by the processor.

4. A vehicle status device mounted in a vehicle for reporting status information for the vehicle and an owner of the vehicle to an external interrogating unit, said status device comprising:

a control processor;

a device memory interfaced with the processor that stores status information for the vehicle and the owner;

a wide area pager receiver that receives encoded updated vehicle and owner information from an external central database through a wide area paging network, and passes the updated information to the processor for storage in the device memory;

a laser detector that detects a dataless laser signal from an external police laser transmitter, and passes an indication of receiving the laser signal to the processor for retrieval of the status information from the device memory;

a response transmitter that receives retrieved encoded vehicle and owner information from the processor, and transits the retrieved encoded vehicle and owner information to the external interrogating unit; and a coder/decoder that decodes the updated information received from the wide area paging network and encodes the information retrieved from the device memory by the processor.

* * * * *